US005478015A

United States Patent [19]

Black

[11] Patent Number: 5,478,015

[45] Date of Patent: Dec. 26, 1995

[54] BACKPACK CLOSED SYSTEM SPRAYER

[76] Inventor: Robert D. Black, P.O. Box 1828, Douglasville, Ga. 30134

[21] Appl. No.: 264,602

[22] Filed: Jun. 23, 1994

[51] Int. Cl.[6] ..... B05B 9/08

[52] U.S. Cl. ..... 239/154; 239/152; 222/175; 224/148

[58] Field of Search ..... 239/152–154, 239/302, 337, 532; 222/175, 401; 224/148

[56] References Cited

U.S. PATENT DOCUMENTS

| | | | |
|---|---|---|---|
| 3,403,818 | 10/1968 | Enssle | 222/175 X |
| 3,721,299 | 3/1973 | Roessler | 239/154 X |
| 3,802,511 | 4/1974 | Good, Jr. | 224/148 X |
| 4,921,143 | 5/1990 | Billet | 224/148 X |
| 4,923,394 | 5/1990 | Fumino | 224/148 X |
| 5,106,005 | 4/1992 | Waldrum | 224/148 X |
| 5,303,847 | 4/1994 | Cottone | 239/154 X |

FOREIGN PATENT DOCUMENTS

| | | | |
|---|---|---|---|
| 856572 | 6/1940 | France | 239/154 |
| 2055868 | 5/1972 | Germany | 239/152 |
| 897286 | 5/1962 | United Kingdom | 239/154 |
| 1136513 | 12/1968 | United Kingdom | 239/154 |
| 2244221 | 11/1991 | United Kingdom | 239/154 |

*Primary Examiner*—Andres Kashnikow
*Assistant Examiner*—Lesley D. Morris
*Attorney, Agent, or Firm*—James A. Hinkle

[57] ABSTRACT

A safety backpack sprayer has a backpack frame onto which a replaceable premixed-spray container is positioned with convenient means. A spray-emission device is attachable to the backpack frame. A tubular conveyance is attachable conveniently intermediate the premixed-spray container and the spray-emission device. A tamper-proof cover or lid on the premixed-spray container prevents or deters putting unauthorized spray or spray components for mixture in the premixed-spray container. The premixed-spray container is structured for marketing distribution and optional refilling by government-authorized sources.

16 Claims, 3 Drawing Sheets

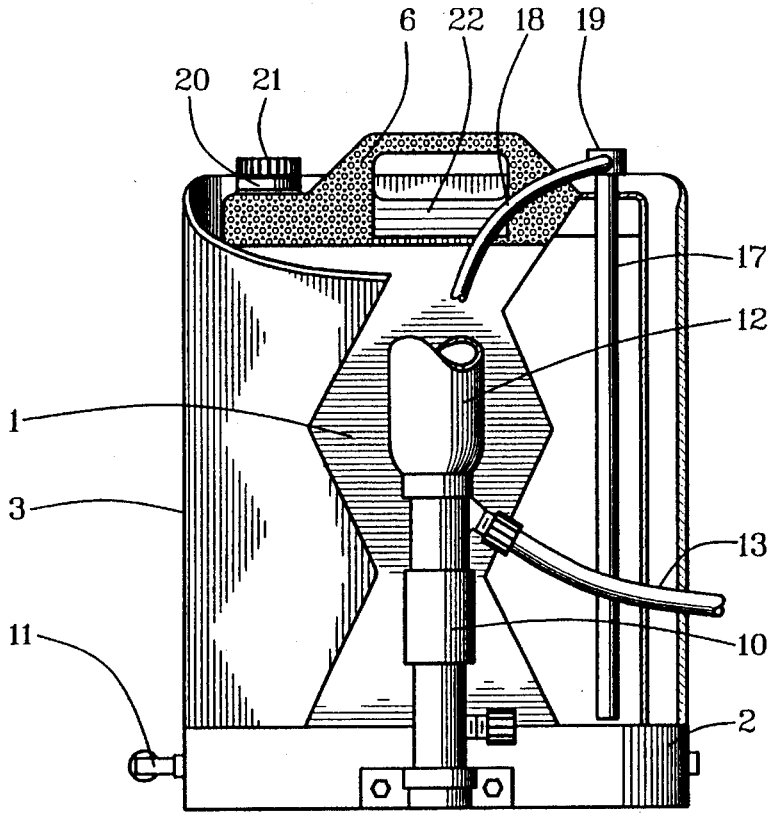
FIG. 3
FIG. 4
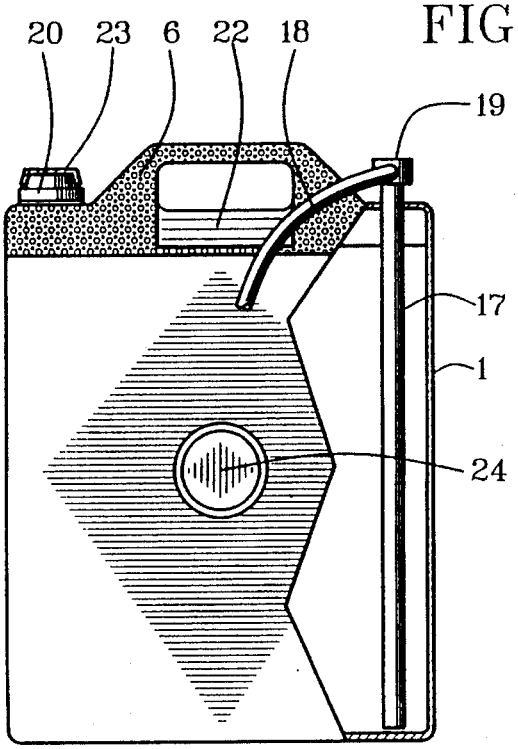
FIG. 5
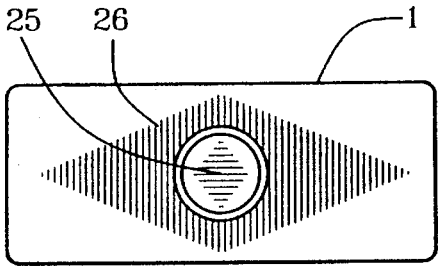

BACKPACK CLOSED SYSTEM SPRAYER

BACKGROUND OF THE INVENTION

I. Field of the Invention

The present invention relates generally to the field of sprayers which are carried on a back of a user. In particular, it relates to backpack sprayers with replaceable containers of premixed spray to avoid danger to users and to the environment from improper mixing, spilling and handling of spray materials.

II. Description of the Prior Art

Previous backpack sprayers have had containers in which spray materials and inert host liquids are mixed while the containers are attached to backpack-carrying and hand-spraying devices. Conventional backpack sprayers have spray containers with a large opening for inserting spray materials and liquids for mixing in the containers. Mixing spray materials and host liquids in containers on assembled backpack sprayers has allowed such hazards as (a) mixing dangerous proportions of toxic spray materials; (b) spilling spray materials on the ground, on spraying equipment, on clothes and on individuals directly; (c) inhaling spray fumes, mist and dust; (d) starting fires; (e) misuse of spray materials; and (f) variously exposing humans, other animals and plant life to hazardous spray materials.

SUMMARY OF THE INVENTION

In accordance with the present invention, it is contemplated that in light of these hazards and related problems in this field, objectives of this invention are to provide a backpack sprayer which:

Has a spray container which is removable from a backpack sprayer for proper filling by qualified and authorized individuals;

Is attachable to backpack sprayers which are designed and built to emit premixed spray;

Prevents unauthorized mixing of sprays in the spray container;

Is inexpensive to produce and to use; and

Is convenient and easy to use.

A backpack sprayer to accomplish these and other objectives has a backpack frame onto which a replaceable premixed-spray container is positioned with quick-release means. A spray-emission means is attachable to the backpack frame. A tubular conveyance is attachable conveniently intermediate the premixed-spray container and the spray-emission means. A tamper-proof lid on the premixed-spray container prevents or deters putting unauthorized spray or spray components for mixture in the premixed-spray container. The premixed-spray container is structured for marketing distribution and optional refilling by government-authorized spray suppliers.

Other objects, advantages and capabilities of the invention will become apparent from the following description taken in conjunction with the accompanying drawings showing preferred embodiments of the invention.

BRIEF DESCRIPTION OF THE DRAWINGS

FIG. 3 is a partially cutaway rear view with a fluid conveyance on one side and a tamper-proof cover on an opposite side of a top of the replaceable spray container;

FIG. 4 is a partially cutaway rear view of a replaceable spray container having a fluid conveyance on one side and having a chemical-seal tamper-proof cover on both an opposite side of a top and on a rear of the replaceable spray container;

FIG. 5 is bottom view of a replaceable spray container having a chemical-seal tamper-proof cover on the bottom;

DESCRIPTION OF THE PREFERRED EMBODIMENTS

Figure 1:
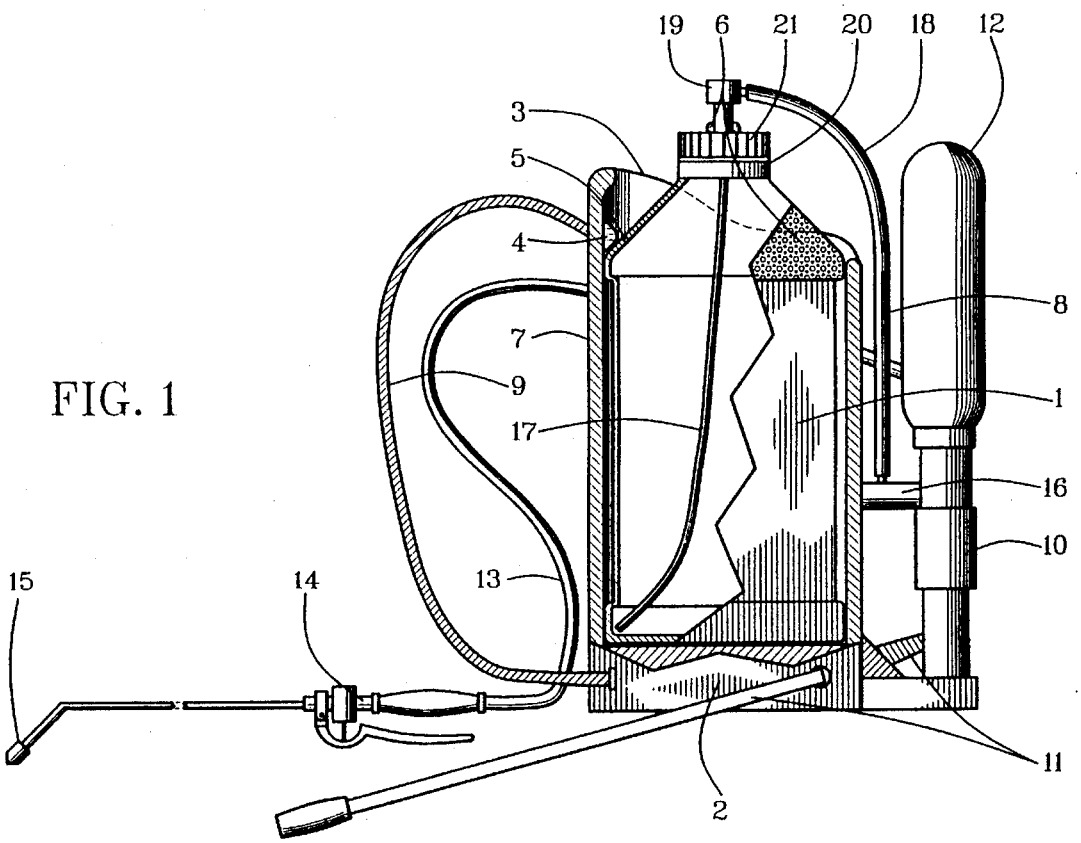
FIG. 1 is a cutaway side elevation view of a replaceable spray container on a backpack frame with a spray-emission means on a rear of the backpack frame.
Figure 2:
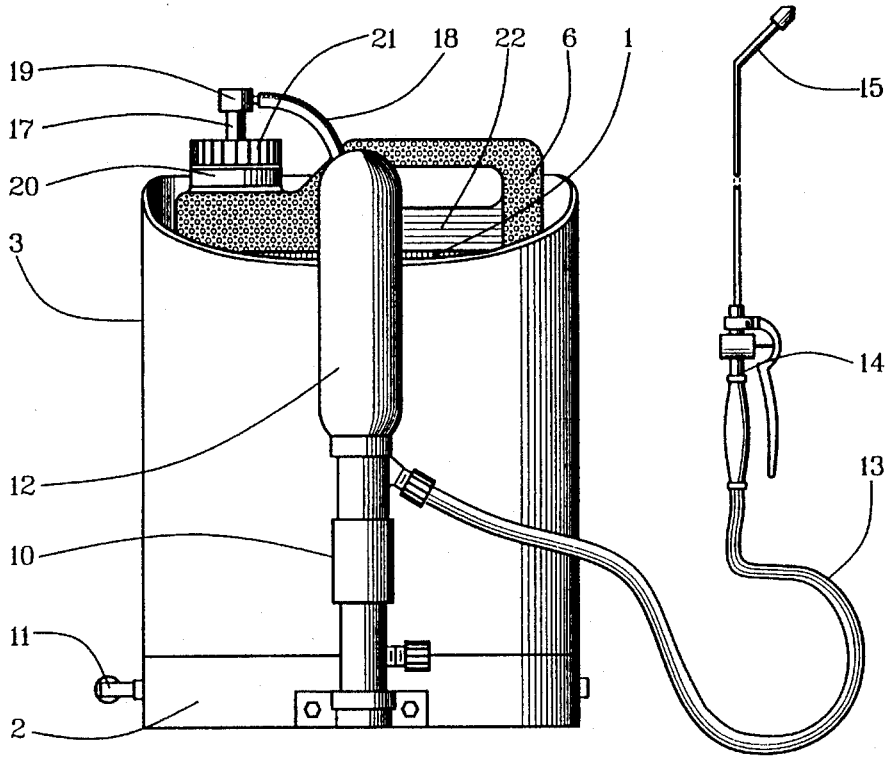
FIG. 2 is a rear view of the FIG. 1 illustration.

Referring to the drawings wherein like reference numerals designate corresponding parts throughout the several figures, reference is made first to FIGS. 1–2. A replaceable spray container 1 is positioned on a container base 22 having a wall 3 that functions as an abutment to hold the replaceable spray container 1 laterally on a backpack frame comprised of the container base 22 and the wall 3. The base 2 and wall 3 combination comprises a hollow, open-top receptacle into which the spray container is placed prior to use. The replaceable spray container 1 can be held vertically on the container base 2 with a latch 4 that extends front a portion of the wall 3 to a restraining position on a lock step 5 that is positioned proximate a handle section 6 that is extended inward and optionally upward from a top portion of the replaceable spray container 1. The wall 3 of the backpack frame can be constructed of selectively rigid and resilient material such as suitable plastic and can have arcuate edges to provide a quick-release spring-locking relationship between a wall front 7 from which the latch 4 is extended and a wall rear 8. A backpack-strap means 9 is attached to the wall front 7 and to the container base 2

Attached to the container base 2 is spray-emission means having a spray pump 10, a pump lever 11, a pressure chamber 12, a spray hose 13, a spray handle 14 and a spray nozzle 15. A variety of pumps can be employed. Typically, however, a piston pump is actuated by the pump lever 11 to draw fluid from the replaceable spray container 1 to a pump-inlet conveyance 16 through a fluid conveyance that can have a container section 17 and a pump section 18 connected with a conveyance connector 19. The fluid is pumped into the pressure chamber 12 in opposition to resilience of air that forces the fluid out through the spray hose 13 when released with spray handle 14 for spraying discharge through the spray nozzle 15. Appropriate pumping mechanisms and valves are assumed.

A selection of tamper-proof covers are provided for a filling aperture 20 that can be positioned variously on the replaceable spray container 1. The simplest type of tamper-proof cover is a threaded tamper-proof cover 21. The term "tamper proof" applies in this case to different levels of resistance to unauthorized reuse of the replaceable spray container 1 as a result of level of difficulty of refilling it through a particular type of tamper-proof cover or lid.

Merely having a threaded tamper-proof cover 21 that is too small in diameter for ease of filling it with spray materials or mixing spray materials in it provides a level of economic resistance to unauthorized reuse or refilling with unauthorized spray materials. It tends to cause users to obtain a new replaceable spray container of authorized spray material or to return an empty one to an authorized dispenser to be refilled with authorized spray material.

Distribution and use of spray material are being controlled by government increasingly. Preventing users of spray from mixing it in containers used on sprayers or mixing it separately and then putting it in the containers on the sprayers is a factor of control and regulation of the use of spray materials. Providing a sprayer with a replaceable spray container 1 aids in accomplishing such government regulation.

In FIGS. 1–2, the conveyance connector 19 is attached to the threaded tamper-proof cover 21. In FIG. 3, the conveyance connector 19 is attached to the replaceable spray container 1 separately from the threaded tamper-proof cover 21. Separate positioning of a tamper-proof cover and the conveyance connector 19 allows greater flexibility in size and type of tamper-proof cover that can be employed. In FIG. 3, for instance, the threaded tamper-proof cover 21 is smaller and positioned at an opposite side of the handle section 6 of the replaceable spray container 1. While similar in outside appearance, either of the tamper-proof covers 21 shown in FIGS. 1–3 could have non-threaded attachment means such as heat bonding or chemical bonding with various adhesives.

In FIGS. 3–4, an identification surface 22 is provided on a slope of the handle section 6. This can be used to indicate where to obtain a new replaceable spray container 1 or for other uses such as information related to authorized obtainment of spray.

In FIGS. 4–7, additionally tamper-proof covers and their selective positioning are shown. In FIG. 4, a press-on tamper-proof cover 23 is employed. It can be held on chemically with an adhesive with or without use of heat in an adhesive process.

Also shown in FIG. 4 is a rear-wall tamper-proof cover 24. It can be positioned on either front, side or rear walls for a similar effect of incapacitating a replaceable spray container 1 by removal for use with unauthorized spray materials. It can be an alternative to the press-on tamper-proof cover 23 that is positioned on a top portion of the replaceable spray container 1.

In FIG. 5, a bottom tamper-proof cover 25 is shown on a bottom 26 of a replaceable spray container 1. Bottom positioning destroys the container by removal to prevent unauthorized use of spray further yet. The replaceable spray container 1 would no longer have a sealed bottom unless replaced by means not generally available to unauthorized users.

Figure 6:
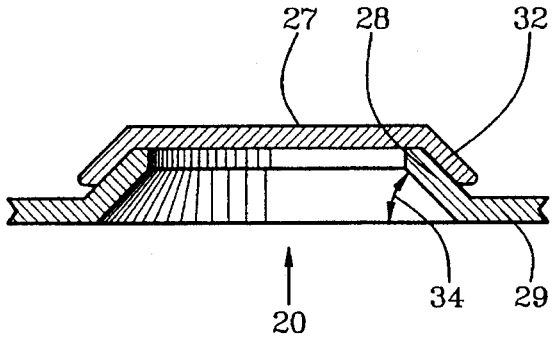
FIG. 6 is a sectional cutaway view of a chemical-seal tamper-proof cover with convex attachment to a surface or to a cover of a replaceable spray container.

A convex tamper-proof cover 27 shown in FIG. 6 fits onto a convex peripheral wall 28 of a filling aperture 20. The filling aperture 20 can be in any wall 29 of the replaceable spray container 1.

Figure 7:
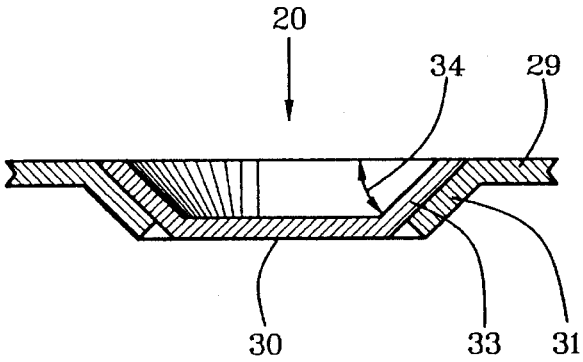
FIG. 7 is a sectional cutaway view of a chemical-seal tamper-proof cover with concave attachment to a surface or to a cover of a replaceable spray container.

A concave tamper-proof cover 30 shown in FIG. 7 fits onto a concave peripheral wall 31 of the filling aperture 20. As for the tamper-proof cover 27, the filling aperture 20 also can be in any wall 29 of the replaceable spray container 1.

The convex tamper-proof cover 27 has a convex cover wall 32 that fits onto the convex peripheral wall 28 of the filling aperture 20. The concave tamper-proof cover 30 has a concave cover wall 33 that fits into the concave peripheral wall 31 of the concave tamper-proof cover 30. Either combination of walls 28 and 32 or 31 and 33 can be adhered and sealed together with a desired heat or non-heat process. Adhering and sealing may be made to require knowledge, skill, equipment and materials not readily available to unauthorized users of spray in the replaceable spray container 1, thereby rendering the tamper-proof covers 23, 24, 25, 27 or 30 relatively more tamper-proof than threaded tamper-proof cover 21.

Slope angle 34 of the combination of walls 28 and 32 or 32 and 33 affect ease of adherence for reuse by potential unauthorized users. Steep slope angles 34 are easier to join than slope angles 34 that are not as steep. A slope angle 34 of 45 degrees is shown as a recommended compromise for some but not all use conditions. Some manufacturers or government regulators may find a steeper slope angle 34 of approximately 85 degrees to be more suitable. A slope angle 34 of less than 90 degrees is recommended, however, to prevent passage of a cover through the filling aperture 20.

The illustration of rear-wall tamper-proof cover 24 in FIG. 4 and the illustration of bottom tamper-proof cover 25 in FIG. 5 are similar to show an outside circumferential portion of such covers as being either convex wall 32 or concave wall 33.

Selection of the convex tamper-proof cover 27 or the concave tamper-proof cover 30 for either wall is a design choice. The concave tamper-proof cover 30 has advantages of not protruding from a wall 29 of the replaceable spray container 1 and of being more difficult to remove and replace without required skill, material and equipment. Not protruding from a wall 29 makes the replaceable spray container 1 safer to use without coming in contact with edges of equipment that might dislodge a cover such as convex tamper-proof cover 27 in some use conditions by some users. Ease of removal of convex tamper-proof cover 27 may be a design advantage for other use conditions and types of spray materials, however.

Figure 8:
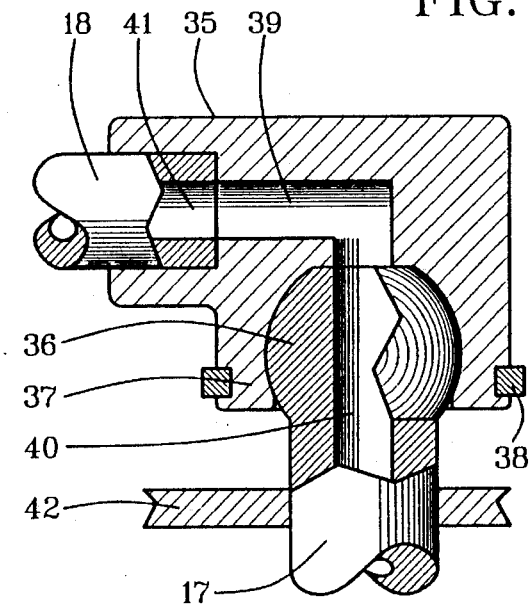
FIG. 8 is sectional cutaway view of a quick-release connection of a fluid conveyance from the replaceable spray container to a fluid conveyance to the spray-emission means.

Referring now to FIG. 8, the container section 17 and the pump section 18 of a fluid conveyance can be joined by a quick-release conveyance connector 35 that is an optional form of the conveyance connector 10 shown in FIGS. 1–4. A variety of quick-release conveyance connectors 135 are foreseeable. Some are known and available on the market for quick-and-easy connection and disconnection of tubular conveyances. This quick-release conveyance connector 135 has a ball-and-socket joint with a relatively rigid ball section 136 that is connected to container section 17 and that fits inside of a spherical socket section 37 that is relatively resilient or expansive. Aiding resilience, particularly for a spherical socket section 137 that is expansive with the aid of slots in an entry skirt, can be a resilient retainer ring 138 having various forms. A connector interior 130 can connect a conveyance interior 40 in the ball section 136 of the container section 17 and a conveyance interior 41 of the pump section 18 of the fluid conveyance. The container section 17 of the fluid conveyance can be connected variously to a select wall 42 that can be either wall of the replaceable spray container 1 or a closure wall of either tamper-proof cover 21, 23, 24, 25, 27 or 30.

Various modifications may be made of the invention without departing from the scope thereof and it is desired, therefore, that only such limitations shall be placed thereon as are imposed by the prior art and which are set forth in the appended claims.

What is claimed is:

1. A safety backpack sprayer comprising:

a backpack frame having a container-attachment means and back-attachment means, the container-attachment means further comprising a unitary open-top hollow receptacle, the container-attachment means having a container base on which a replaceable spray container is positioned, a container abutment on edges of the container base in restrictive relationship to lateral travel of the replaceable spray container on the container base, and a latch in restrictive relationship to upward vertical travel of the replaceable spray container from the container base, the container abutment being a wall constructed of selectively resilient and rigid material and extended upward vertically from an outside perimeter of the container base to a position proximate a top of the replaceable spray container and the latch is a portion of a side of the wall that is extended laterally to a restraining position on a top portion of the replaceable spray container, a spray-emission means attachable to the backpack frame, a replaceable spray container sized and shaped to fit onto the container-attachment means, the replaceable spray container having a handle section extended vertically above and inwardly from at least one side of a top of a fluid-container portion of the replaceable spray container, and the handle section having a lock step that is positioned vertically under the latch in resilient-release relationship to restrictive upward vertical travel of the replaceable spray container for quick-release removal of the replaceable spray container from the container-attachment means, a fluid conveyance means in fluid communication intermediate the replaceable spray container and the spray-emission means, a filling aperture in the replaceable spray container, and a tamper-proof cover means on the filling aperture.

2. A safety backpack sprayer as claimed in claim 1 wherein said filling aperture is on a portion of the handle section.

3. A safety backpack sprayer as claimed in claim 2 and further comprising a lid on the filling aperture, and a fluid-conveyance aperture in the lid.

4. A safety backpack sprayer as claimed in claim 3 wherein said fluid conveyance means includes a fluid-conveyance tube in fluid conveyance between an inside bottom of the replaceable spray container and the spray-emission means.

5. A safety backpack sprayer as claimed in claim 1 wherein said fluid conveyance means includes a fluid-conveyance aperture proximate the handle section of the replaceable spray container, and a fluid-conveyance tube in fluid-conveyance between an inside bottom of the replaceable spray container and the spray-emission means.

6. A safety backpack sprayer as claimed in claim 1 wherein the filling aperture is positioned in a desired wall of the replaceable spray container, and the tamper-proof cover is a factory-sealed lid on the filling aperture.

7. A safety backpack sprayer as claimed in claim 6 wherein the filling aperture is positioned in a side wall of the replaceable spray container, such that removal of the factory-sealed lid for unauthorized refill renders the replaceable spray container incapable of containing fluid above the filling aperture and, therefore, unusable.

8. A safety backpack sprayer as claimed in claim 6 wherein the filling aperture is positioned in a top wall of the replaceable spray container, such that removal of the factory-sealed lid for unauthorized refill renders the replaceable spray container incapable of preventing fluid from splashing up through the filling aperture and, therefore, unsuitable for unauthorized use.

9. A safety backpack sprayer as claimed in claim 6 wherein the filling aperture is positioned in a bottom wall of the replaceable spray container, such that removal of the factory-sealed lid for unauthorized refill renders the replaceable spray container incapable of containing fluid and, therefore, unsuitable for unauthorized use.

10. A safety backpack sprayer as claimed in claim 6 wherein a peripheral wall of the filling aperture is tapered conically with a major diameter at an outside edge of the filling aperture and a minor diameter at an inside edge of the filling aperture, and the tamper-proof cover is a tapered lid having a peripheral wall which matches and fits into the peripheral wall of the filling aperture with a means for sealing the peripheral wall of the filling aperture and the tamper-proof cover together.

11. A safety backpack sprayer as claimed in claim 6 wherein a peripheral wall of the filling aperture is tapered conically with a major diameter at an inside edge of the filling aperture and a minor diameter at an outside edge of the filling aperture, and the tamper-proof cover is a tapered lid having a peripheral wall which matches and fits onto the peripheral wall of the filling aperture with a means for sealing the peripheral wall of the filling aperture and the tamper-proof cover together.

12. A safety backpack sprayer as claimed in claim 6 wherein the replaceable spray container and the tamper-proof cover are made of plastic materials which are chemically sealed together.

13. A safety backpack sprayer as claimed in claim 6 wherein the replaceable spray container and the tamper-proof cover are made of plastic materials which are heat-sealed together with chemical bonding.

14. A safety backpack sprayer as claimed in claim 6 wherein said fluid conveyance means includes a fluid-conveyance aperture in the factory-sealed lid, and a fluid-conveyance tube in fluid conveyance between an inside periphery of the replaceable spray container and the spray-emission means.

15. A safety backpack sprayer as claimed in claim 14 and further comprising an automatic-sealing means with which a container section of the fluid-conveyance tube is attached to a pump section of the fluid-conveyance tube.

16. A safety backpack sprayer as claimed in claim 1 and further comprising an identification surface on the handle section of the replaceable spray container.

* * * * *